US009163647B2

(12) United States Patent
Nesbitt

(10) Patent No.: US 9,163,647 B2
(45) Date of Patent: Oct. 20, 2015

(54) COMPACT FORCE MULTIPLYING PNEUMATIC ACTUATOR

(75) Inventor: Clay Nesbitt, Benicia, CA (US)

(73) Assignee: Parker-Hannifin Corporation, Cleveland, OH (US)

( * ) Notice: Subject to any disclaimer, the term of this patent is extended or adjusted under 35 U.S.C. 154(b) by 592 days.

(21) Appl. No.: 13/505,479

(22) PCT Filed: Jan. 26, 2010

(86) PCT No.: PCT/US2010/022029
§ 371 (c)(1),
(2), (4) Date: May 2, 2012

(87) PCT Pub. No.: WO2011/056245
PCT Pub. Date: May 12, 2011

(65) Prior Publication Data
US 2012/0222547 A1 Sep. 6, 2012

Related U.S. Application Data

(60) Provisional application No. 61/258,381, filed on Nov. 5, 2009.

(51) Int. Cl.
*F15B 15/02* (2006.01)

(52) U.S. Cl.
CPC ..... *F15B 15/02* (2013.01)

(58) Field of Classification Search
CPC ..... F03C 1/13; F03C 1/26; F15B 15/02; F15B 15/1476; F15B 15/148
USPC ..... 92/129, 130 B, 140
See application file for complete search history.

(56) References Cited

U.S. PATENT DOCUMENTS 2,134,227 A * 10/1938 Forkardt ..... 92/140
2,651,207 A * 9/1953 Olson ..... 92/140
3,554,088 A * 1/1971 Bruyn ..... 92/130 B
(Continued)

FOREIGN PATENT DOCUMENTS

CH 313843 5/1956
CN 1678857 A 10/2005
(Continued)

OTHER PUBLICATIONS

International Search Report for corresponding patent application No. PCT/US2010/022029 dated Jul. 22, 2010.
(Continued)

*Primary Examiner* — F. Daniel Lopez
(74) *Attorney, Agent, or Firm* — Renner, Otto, Boisselle & Sklar, LLP

(57) ABSTRACT

A compact force multiplying actuator 10 and its associated valve 20 are disclosed. The actuator 10 and valve 20 include piston heads 31 and 32 and force multiplying load beams 52 and 53. Belleville springs 81 and 82 are disposed axially between the piston heads 31, 32 and the load beams 52, 53. The Belleville springs 81 and 82 act through an output member 71 to retain a valve member 88 in a closed position. When pneumatic pressure is applied against the piston heads 31 and 32, movement of the piston heads 31 and 32 is transferred through a force transfer member 45 and through the force multiplying load beams 52 and 53 to move the output member 71 against the bias of the Belleville springs 81 and 82 to allow the valve member 88 to open.

16 Claims, 4 Drawing Sheets

(56) References Cited

U.S. PATENT DOCUMENTS

| | | | | |
|---|---|---|---|---|
| 3,881,400 | A * | 5/1975 | Lewis | 92/52 |
| 4,552,056 | A * | 11/1985 | McKay | 92/130 B |
| 4,791,856 | A | 12/1988 | Heim | |
| 4,875,404 | A * | 10/1989 | Aldridge | 92/140 |
| 5,215,286 | A | 6/1993 | Kolenc | |
| 5,370,039 | A * | 12/1994 | Kirsching | 92/140 |
| 2005/0269534 | A1 | 12/2005 | Tanikawa et al. | |

FOREIGN PATENT DOCUMENTS

| | | |
|---|---|---|
| JP | 2000-9254 | 1/2000 |
| TW | I290196 | 11/2007 |

OTHER PUBLICATIONS

Office Action with translation for corresponding Chinese Patent Application No. 201080050339.2 dated Jan. 26, 2015.

English translation of Office Action in corresponding Chinese Patent Application No. 201080050339.2 dated May 26, 2014.

English translation of Office Action in corresponding Japanese Patent Application No. 2012-537865 dated Oct. 2, 2013.

Search Report for corresponding Taiwan Patent Application No. 099104866 dated Mar. 29, 2015.

* cited by examiner

COMPACT FORCE MULTIPLYING PNEUMATIC ACTUATOR

CROSS REFERENCE TO RELATED APPLICATIONS

This application is a national phase of International Application No. PCT/US2010/022029 filed Jan. 26, 2010 and published in the English language, which claims the benefit of U.S. Provisional Application No. 61/258,381 filed Nov. 5, 2009, all of which are incorporated herein by reference.

TECHNICAL FIELD

This invention relates to pneumatic actuators. More specifically, this invention relates to a compact force multiplying pneumatic actuator. Still more specifically, this invention relates to such an actuator in which a spring biases an output member to a first position to close a valve, and pneumatic pressure moves the output member against the spring bias to a second position to allow the valve to open.

BACKGROUND OF THE INVENTION

Pneumatic actuators are motion control devices that are used to cause and control motion. Such actuators commonly include a pneumatic chamber to which pneumatic pressure is selectively connected and vented, and a piston head in the chamber that is acted upon and moved by the pneumatic pressure. The movement of the piston head is transferred to an output member that is to be moved.

One type of pneumatic actuator includes a spring that biases the output member to a first or normal or at rest position. When the pneumatic pressure is connected to the pneumatic chamber so that it acts against and moves the piston, this movement of the piston causes the output member to move against the bias of the spring to a second or actuated position.

For certain uses of pneumatic actuators of this type, it is desirable to provide a high spring bias force and a resulting high output force of the output member. This high output force is able to move large loads to a first position and hold those loads in that position for indeterminate lengths of time without pneumatic pressure input. It is also desirable for pneumatic actuators of this type to overcome the bias of the high spring force, and cause and control movement of the output member to a second position, with low, readily available pneumatic pressure (commonly called shop air pressure). Furthermore, it is desirable to provide such a pneumatic actuator that is compact in size for use in confined spaces.

One application for pneumatic actuators of the general type described above is to operate high pressure valves that control the flow of high pressure fluid. In this application, the pneumatic actuator may be secured to a standard mounting arrangement on the high pressure valve, and the output member may control the operation of the valve. The spring biased first position of the output member holds the valve in one position, and movement of the output member to its second position by operation of pneumatic pressure on the piston head allows the valve to move to another position.

SUMMARY OF THE INVENTION

This invention provides a compact force multiplying pneumatic actuator. The actuator may include an input member assembly, a load beam assembly, an output member assembly, and a biasing member assembly. A valve member assembly may also be provided.

The input member assembly, load beam assembly, output member assembly and biasing member assembly may all be disposed in a common housing in coaxial alignment. The input member may include one or more piston heads disposed in one end region of the housing, and the load beam assembly may include one or more force multiplying load beams disposed at an opposite end region of the housing. One or more biasing members and an output member may be disposed between the piston head(s) and the load beam(s).

The input member assembly may also include an input force transfer member that extends axially from one of the piston heads, and past the biasing member(s) and the output member, to operably connect with the load beam(s). The input force transfer member may be disposed radially between the biasing member(s) and the output member, so that the biasing member(s) and the output member are nested radially within the input force transfer member.

The input member assembly may also include one or more variable volume fluid pressure chamber defined by the housing and the piston head(s). Fluid pressure may be supplied to or vented from the fluid pressure chamber to move the piston head(s), and movement of the piston head(s) may be transferred to the load beams by the input force transfer member.

The load beam(s) may be disposed in a plane substantially perpendicular to the axis and may be mounted for pivotal movement about a pivot axis that provides a longer load beam arm and a shorter load beam arm. The input force transfer member may be operably connected to the longer load beam arm(s), and the shorter load beam arm(s) may be operably connected to cause movement of the output member against the bias of the biasing member(s).

The valve member assembly may include a valve member that is operably connected to open and close fluid flow in response to movement of the output member.

The input member assembly, load beam assembly, output member assembly, biasing member assembly, and valve member assembly may all have a first or normal or spring biased position, in which the biasing member(s) retains such assemblies in such position when fluid pressure is vented from the variable volume fluid pressure chamber. When fluid pressure is supplied to the chamber, the piston head(s) may move axially and the input force transfer member may act against the longer arm(s) to pivot the load beam member(s) and cause the shorter arm(s) of the load beam members to act against the output member with a force that is multiplied by the mechanical advantage of the load beam(s). The movement of the output member is transferred to the valve member assembly by an output shaft that extends past the load beam assembly toward the valve member assembly. This causes the input member assembly, the load beam assembly, the output member assembly, the biasing member assembly, and the valve member assembly to all be moved to and retained in a second or actuated position.

The invention also provides various ones of the features and structures described in the claims set out below, alone and in combination, which claims are incorporated by reference in this summary of the invention.

BRIEF DESCRIPTION OF THE DRAWINGS

Embodiments of this invention will now be described in further detail with reference to the accompanying drawings, in which.

DETAILED DESCRIPTION OF THE INVENTION

The principles, embodiments and operation of the present invention are shown in the accompanying drawings and described in detail herein. These drawings and this description are not to be construed as being limited to the particular illustrative forms of the invention disclosed. It will thus become apparent to those skilled in the art that various modifications of the embodiments herein can be made without departing from the spirit or scope of the invention.

Figure 1:
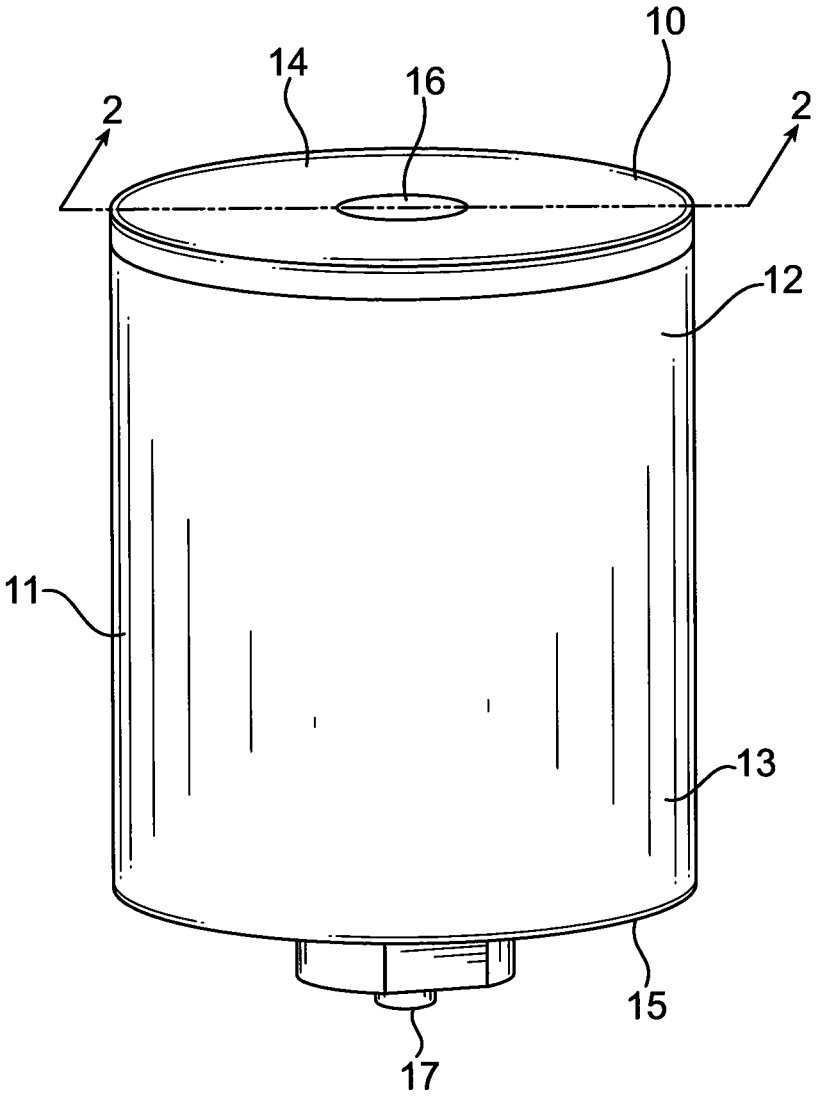
FIG. 1 is a perspective view of a pneumatic actuator according to a preferred embodiment incorporating certain principles of this invention.

FIG. 1 illustrates a compact force multiplying pneumatic actuator 10. The actuator 10 is a motion control device that receives fluid pressure as an input to cause and control mechanical motion. The actuator 10 includes a generally cylindrical, axial extending, cup shaped housing 11 that has a first axial end region 12 and a second axial end region 13. The end regions 12 and 13 are closed, respectively, by first and second end caps 14 and 15, and the end regions 12 and 13 extend axially from their respective end caps toward one another and meet at substantially the axial midpoint of the housing 11.

The first end cap 14 includes a fluid pressure port 16 that is externally connected to a source of fluid pressure through a pressure control valve that selectively connects the source to and vents the source from the port 16. In the preferred embodiment, the first end cap 14 is a separate part that is threaded into the housing 11, for ease of assembly of the various components of the actuator 10 from the top or first end region 12. Alternatively, the end cap 14 may be formed integral with the housing 11, for example, if the various components of the actuator 10 are to be assembled from the bottom or second end region 13. The housing 11 and end caps 14 and 15 and port 16 are all disposed along a longitudinal axis 18.

The pneumatic pressure source, the pressure control valve and the connection to the port 16 are well known and are not shown in FIG. 1. In the preferred embodiment, the source of fluid pressure provides pneumatic pressure to the port 16 at pressure in the range of about 4.5 bar to about 8.5 bar (about 65 pounds per square inch to about 125 pounds per square inch). This pressure range is referred to as "shop air" pressure, because it is the air pressure available from an air pressure storage chamber in many work shop areas. The lower level of this pressure range is the minimum design pressure for moving the actuator as described further below, and the upper level of this pressure range is the maximum design pressure, for the preferred embodiment shown in the drawings. Other alternative design pressures may be used, depending upon the application for the actuator 10.

The second end cap 15 includes a threaded connector and mechanical output port 17 that allows the actuator 10 to be removably connected to any device that is to be operated by the actuator 10 and that allows the output force of the actuator 10 to be transferred to such device. Alternative arrangements for removably or permanently connecting the actuator 10 to such device, such as bolted flange joints or snap ring joints or other known connector arrangements, may also be used. The second end cap 15 in the preferred embodiment is formed integral with the housing 11 for ease of manufacture. Alternatively, the end cap 15 may be a separate member. The operated device may be an electrical switch, a clutch, or any other device that requires motion control to move the device to and hold the device at a particular position. In the preferred embodiment of the invention, the operated device is a high pressure fluid control valve 20.

Figure 2:
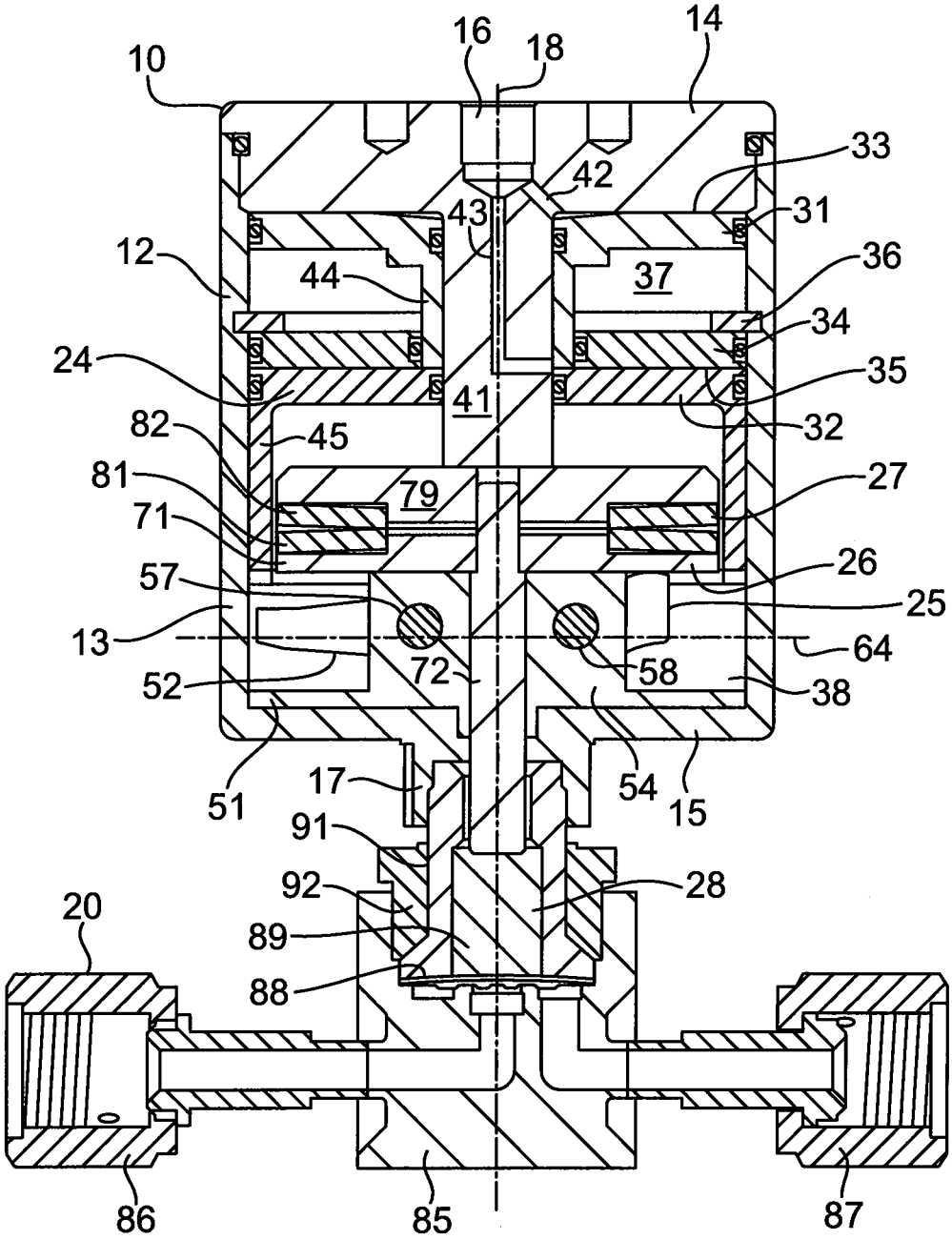
FIG. 2 is cross sectional side view along reference view line 2-2 in FIG. 1, showing the pneumatic actuator in a first position, and with a high pressure flow control valve connected with the actuator.

Referring now to FIG. 2, the actuator 10 is shown in cross section, in combination with its associated valve 20 which is also shown in cross section. The actuator 10 and valve 20 include an input member assembly 24, a load beam assembly 25, an output member assembly 26, a biasing member assembly 27, and a valve member assembly 28. Unless otherwise indicated in the drawings or description below, most of the component parts of the actuator 10 and the valve 20 are of stainless steel, preferably high carbon chromium stainless steel according to American Iron and Steel Institute specification 440-C condition A or American Society for Testing Materials specification A276.

The input member assembly 24 includes a first generally flat piston head 31 and a second generally flat piston head 32, each of which is axially slidable within the first end region 12 of the housing 11. The piston heads 31 and 32 each have a generally cylindrical outer periphery, and a suitable o-ring seal on the outer periphery of each piston head 31 and 32 provides slidable sealing engagement with the inner peripheral surface of the housing 11. The first piston head 31 and the housing 11 and the end cap 14 cooperatively define a first variable volume fluid pressure chamber 33, and the second piston head 32 and the housing 11 and a generally flat separation disk 34 cooperatively define a second variable volume fluid pressure chamber 35. The separation disk 34 includes generally cylindrical inner and outer peripheral surfaces, and each of those surfaces include circumferential grooves that carry suitable o-ring seals to provide slidable sealing engagement with its respective adjacent surface. A snap ring 36 is received in a circumferential groove in the inner peripheral surface of the first region 12 of the housing 11 to prevent movement of the separation disk in one axial direction within the housing 11, and fluid pressure in the second variable volume pressure chamber 35 and the second piston head 32 urge the separation disk against the snap ring 36. One or more holes (not shown) in the first end region 12 of the housing 11 extend radially completely through the housing 11 and communicate ambient atmospheric pressure from the outside of the housing 11 to the grove in which the snap ring 36 is disposed. These holes continuously vent to ambient atmospheric pressure a vent chamber 37 defined by the separation disk 34 and the interior peripheral surface of the first region of the housing 11 and the first piston head 12. Other holes (not shown) in the second end region 13 of the housing 11 extend radially completely through the housing 11 and communicate ambient atmospheric pressure from the outside of the housing 11 to another vent chamber 38 on the opposite side of the piston head 32 from the pressure chamber 35

The end cap 12 includes a central cylindrical guide and stop member 41 that extends axially from the end cap 12 toward the output member assembly 26. In the preferred embodiment, the guide and stop member 41 is formed integral with the end cap 12, but alternatively the member 41 may be a separate piece that may be attached to the end cap 12 by a treaded connection or any other suitable connection device. The end cap 12 and the guide and stop member 41 include central passages 42 and 43 that establish open fluid pressure communication between the fluid pressure port 16 and the variable volume fluid pressure chambers 33 and 35, respectively. A first generally cylindrical input force transfer member 44 extends axially from the first piston head 31, and the inner peripheral surface of the member 44 slides relative to the outer peripheral surface of the guide and stop member 41 to guide axial movement of the piston head 31, maintain proper alignment of the piston head 31 within the housing 11, and transfer force from the piston head 31 to the piston head 32 in a manner more fully described below. In the preferred embodiment, the input force transfer member 44 is formed integral with the piston head 31.

A second generally cylindrical input force transfer member 45 extends axially from the second piston head 32, past the output member assembly 26 and biasing member assembly 27, toward the load beam assembly 25. In the preferred embodiment, the input force transfer member 45 is formed integral with the piston head 32. The member 45 guides axial movement of the piston head 32, maintains proper alignment of the piston head 32 within the housing 11, and transfers force from the piston head 32 to the load beam assembly 25 in a manner more fully described below. The force transfer member 45 is disposed radially between the housing 11 and each of the output member assembly 26 and biasing member assembly 27, so that the output member assembly 26 and the biasing member assembly 27 are nested within the member 45 as the member moves axially within the housing 11 to operate the load beam assembly 25 as more fully described below.

Figure 3:
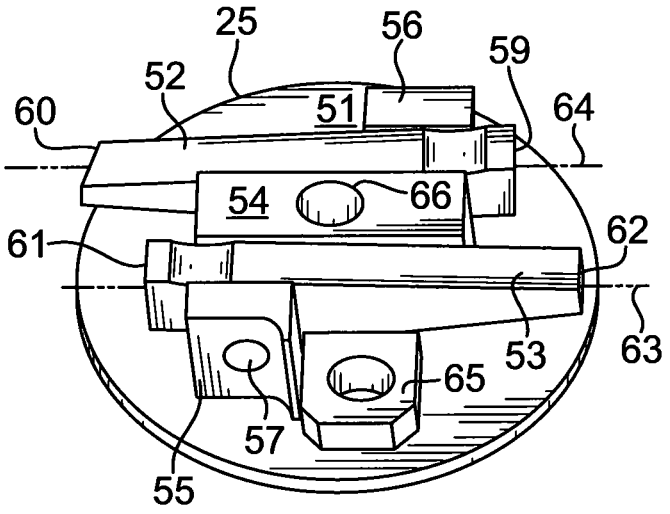
FIG. 3 is an enlarged perspective view of a load beam assembly used in the pneumatic actuator shown in FIGS. 1 and 2.

Referring now to FIGS. 2 and 3 together, the load beam assembly 25 includes a load beam mounting plate 51, load beams 52 and 53, load beam mounting blocks 54, 55 and 56, and pivot pins 57 and 58. The load beam mounting plate 51 is a generally flat round plate that rests against the end cap 15 during operation of the actuator 10. The center mounting block 54 and the blocks 55 and 56 are formed integral with the mounting plate 51. Alternatively, some or all of the mounting blocks could be separate parts that are secured to the mounting plate 51 by suitable threaded fasteners or other appropriate means. Also, the load beam mounting plate 51 could provide a removable end cap for the end region 13 or bottom of the housing 11 in place of the integral end cap 15 shown in the drawings, particularly if the components of the actuator 10 are to be assembled into the housing 11 from the end region 13 or bottom of the housing 11.

The pivot pin 57 extends through suitable holes in the mounting blocks 55 and 54 to pivotally locate the load beam 53 about a pivot axis defined by the pivot pin 57. Similarly, the pivot pin 58 extends through suitable holes in the mounting blocks 56 and 54 to pivotally locate the load beam 52 about a pivot axis defined by the pivot pin 58. If desired, suitable bearings (not shown) can be arranged on the pivot pins 57 and 58 to reduce friction and wear as the load beams move about their respective pivot axes. The load beam 52 includes first and second arms that extend from the pivot axis laterally outwardly to first and second ends 60 and 59, with the length of the first arm being substantially greater than the length of the first arm. Similarly, the load beam 53 includes first and second arms that extend from the pivot axis laterally outwardly to first and second ends 62 and 61, with the length of the first arm being substantially greater than the length of the first arm. The length of each of the first arms is more than two times greater, and preferably more than three times greater, than the length of the shorter arms. Also, the length of each load beam 52 and 53 in the preferred embodiment is at least about eighty percent of the diameter of the inside of the housing 11, to provide maximum mechanical advantage and length of travel and symmetrical distribution of actuation force against the output member assembly 26 by the shorter arms during operation as described further below. Alternatively, other lengths of the load beams, numbers of load beams, and mechanical advantage may be provided, depending upon the desired size of the actuator and available pneumatic pressure and output force and travel requirements for the actuator 10. For example, the load beams may be arranged in a more generally radial direction, with shorter load beams and greater numbers of load beams, particularly if compact size and high output force are not critical.

The load beams 52 and 53 in FIGS. 2 and 3 are disposed in a normal or spring biased or at rest position, as more fully described below. In this position, the load beam 52 and its ends 59 and 60 and its pivot axis about the pivot pin 57 are disposed along a longitudinal axis 63 that is substantially perpendicular to the longitudinal axis 18 of the housing 11. The term substantially perpendicular means about ninety degrees, plus or minus about twenty degrees. Similarly, the load beam 53 is also disposed in a normal or spring biased or at rest position as viewed in FIGS. 2 and 3, as more fully described below. In this position, the load beam 53 and its ends 61 and 62 and its pivot axis about the pivot pin 58 are disposed along an axis 64 that is substantially perpendicular to the longitudinal axis 18 of the housing 11.

A central guide opening 66 in the mounting plate 54 and a limit switch mounting block 65 are also provided by the load beam assembly 25. The central guide opening 66 maintains alignment of other components of the actuator 10, as described further below. The limit switch mounting block includes a threaded opening that is aligned with a corresponding opening in the load beam plate 51. A limit switch (not shown) is threaded into the opening in the load beam plate 51 and the opening in the mounting block 65, to provide a signal to indicate the position of the load beam 53 and thereby provide a signal to indicate the position of the output member assembly 26. If a limit switch is not to be used, a suitable plug is threaded into the opening in the load beam plate 51 and the opening in the mounting block 65, to prevent contaminants from entering the interior of the housing 11.

Referring again to FIG. 2, the output member assembly 26 includes an output member plate 71. The output member plate 71 is held against the block 54 in a first or normal or at rest position shown in FIG. 2 by the biasing member assembly 27, as more fully described below. An output member actuator 72 is secured for movement with the output member plate 71 and is also shown in its first or normal or at rest position in FIG. 2. The output member actuator 72 extends axially from the output member plate 71, through the guide opening 66, and into the connector and mechanical output port 17, to cause and control movement of the valve 20 or other device that is to be actuated. The output member 71 is disposed within the housing 11, axially between the input member assembly 24 and the load beam assembly 25, and radially inwardly of the input force transfer member 45.

The biasing member assembly 27 includes a stationary bias plate 79 and springs 81 and 82. The bias plate 79 is retained against the guide and stop member 41 under all operating conditions, to provide a stationary plate for the springs 81 and 82 to act against. The springs 81 and 82 may be any suitable spring device, and in the preferred embodiment the springs 81 and 82 are Belleville springs arranged in a series configuration to provide high spring force and high axial travel from a first or normal position shown in FIG. 2 to a second or actuated position shown in FIG. 4 and more fully described below. The end of the springs 81 and 82 that is moveable acts against the output member plate 71 under all conditions. The biasing member assembly 27 and its biasing members 81 and 82 are disposed within the housing 11, axially between the input member assembly 24 and the load beam assembly 25, axially between the output member plate 71 and the input member assembly 24, and radially inwardly of the input force transfer member 45. When the biasing member assembly 27 is in its first or normal position shown in FIG. 2, the biasing members 81 and 82 are in a partially compressed position to apply a high force to bias the output member plate 71 firmly against the block 54 and to retain the output member plate 71 in this first or at rest or spring biased position against any opposing forces. In the preferred embodiment, the force applied by the biasing members 81 and 82 against the output member 71 in their first positions is in the range of about 175 to about 275 kilograms (about 400 to 600 pounds).

The valve 2 and valve member assembly 28 are well known and include a valve housing 85, fluid ports 86 and 87 that are connected to place the valve member assembly 28 in a fluid flow stream in a fluid system (not shown) to control flow of fluid, a flexible valve member 88, and a valve member actuator 89. A first connector 91 is in threaded releasable engagement with the output port 17 of the actuator 10, and a second connector 92 is in threaded engagement with the valve housing 85 to connect the first connector 91 to the valve housing 85. The valve member actuator 89 and valve member 88 are shown in FIG. 2 in a first of closed position to close and prevent the flow of fluid through the valve housing 85 between the ports 86 and 87. The actuator 10 in this position (which is the first or spring biased or actuated position of the actuator 10 and its components) applies a constant high force from the output member 71 through the output member actuator 72 and against the valve member actuator 89 to retain the valve member 88 in this closed position. This constant high force is sufficiently great that it overcomes the opposing force created by fluid pressure in the valve 20 that acts against the valve member 88 in a direction to try to open the valve member 88. During this mode of operation, the pneumatic pressure in the variable volume chambers 33 and 35 is vented to atmospheric pressure. The piston heads 31 and 32 remain in their first or at rest positions shown in FIGS. 2, and the first and second input force transfer members 44 and 45 do not apply a significant force against the load beam assembly 25.

Figure 4:
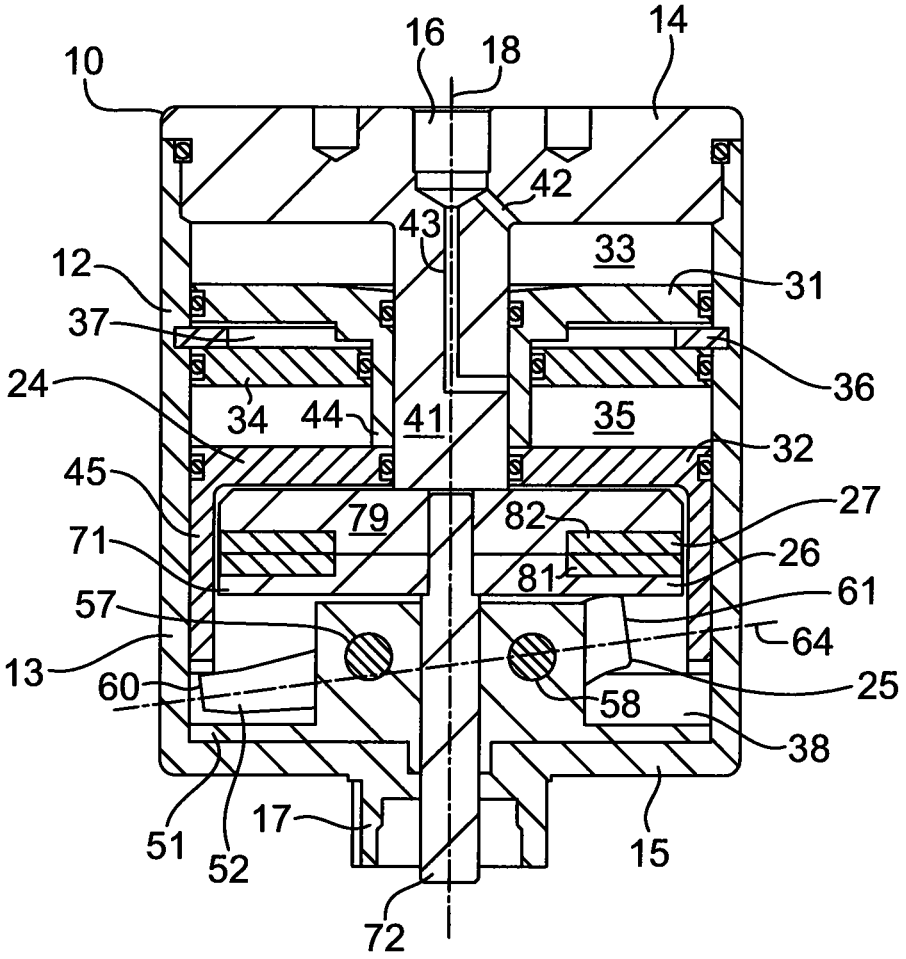
FIG. 4 is a view similar to FIG. 2, but showing the pneumatic actuator in a second position and with the high pressure control valve removed.

When it is desired to open the valve 20, the actuator 10 moves from its first or at rest position shown in FIG. 2 to its second or actuated position shown in FIG. 4. To accomplish this, pneumatic pressure in the range provided by shop air pressure is supplied through the port 16 and the passages 42 and 43 to the variable volume chambers 33 and 35 of the actuator 10. Because the vent chambers 37 and 38 remain at ambient atmospheric pressure during all conditions, the first piston head 31 and the second piston head 32 begin to move away from their respective first or at rest positions in a direction toward the load beam assembly 25 until the second input force transfer member 45 engages the longer arms of each of the load beams 52 and 53. As this is occurring, a first input force created by the pneumatic pressure in the first chamber 33 acting against the first piston head 31 is transferred to the second piston head 32 by the first input force transfer member 44. This first input force, plus a second input force of substantially equal magnitude created by the pneumatic pressure in the second chamber 35 acting against the second piston head 32, provides a total input force that is transferred by the force transfer member 45 to the ends 60 and 62 of the longer arms of the load beams 52 and 53, respectively.

When the pneumatic pressure in the chambers 33 and 35 reaches a sufficiently high level, the total input force acting against the longer arms of the load beams 52 and 53 causes the ends 60 and 62 of the longer arms to begin to move axially in a direction away from the biasing members 81 and 82. The load beams 52 and 53 then begin to pivot about their respective pivot axes defined by the pivot pins 56 and 57, respectively. This causes the ends 59 and 60 of the shorter arms of the load beams 52 and 53 to begin to move against the output member 71 toward the biasing members 81 and 82, to move the output member 71 in a direction reduce the normal or at rest force on the valve actuator member 89 and to further compress the springs 81 and 82. Because the longer arms are a multiple of the length of the shorter arms, a mechanical advantage is provided by the load beams 52 and 53. The force acting against the output plate 71 by the shorter arms of the load beams 52 and 53 to move the output plate 71 away from its first or normal or at rest position shown in FIG. 2 is a multiple of the above mentioned total input force provided by the input member assembly 24. This movement of the output plate 71 causes the output actuator 72 to move away from the valve actuator 89 and valve member 88, so that fluid pressure in the valve 20 acting against the valve member 88 moves the valve member 88 away from its valve seat to begin to open fluid flow through the valve 20.

This movement continues, until the input member assembly 24 and the load beam assembly 25 and the output member assembly 26 and the biasing member assembly 27 are all in the actuated positions shown in FIG. 4 and the valve member assembly 28 is fully open. Referring to FIG. 4, the pneumatic pressure in the chambers 33 and 35 has moved the piston heads 32 and 33 to, and holds the piston heads 32 and 33 at, a second or actuated position shown in FIG. 4. In this actuated position, the input force transfer member 45 transfers the combined forces created by the pneumatic pressure in the chambers 33 and 35 acting against the lateral cross sectional areas of the piston heads 31 and 32 exposed to such pressure to the ends 60 and 62 of the load beams 52 and 53, respectively. This force applied against the longer arms of the load beams 52 and 53 is multiplied by the mechanical advantage of the load beams 52 and 53 and moves the output plate 71 to and retains the output plate 71 at its actuated position shown in FIG. 4. The biasing members 81 and 82 in this position with the valve member 20 open are further compressed, and the spring bias force of the biasing members 81 and 82 is at a maximum. This maximum force of the biasing member assembly 27 is available to return the actuator 10 to its first or at rest position and to close the valve 20 when desired. In the preferred embodiment, the axial force provided by the biasing members 81 and 82 against the output member 71 is in the range of about 450 to about 550 kilograms (about 1000 to 1200 pounds), and the travel of the output member 71 from its first position to its second position is in the range of about 0.7 millimeters to about 1.5 millimeters (0.030 inches to about 0.060 inches). Other biasing forces and travel distances may alternatively be provided, depending upon the requirements of the device that is to be operated by the actuator 10.

When the load beam 52 is moved to this second or actuated position shown if FIG. 4 to allow the valve 20 to open, the axis 63 is rotated from its first position shown in FIG. 2 to a position shown in FIG. 4. Additionally, when this occurs, the longer arm of the load beam 52 is moved in a direction axially away from the biasing member assembly 27 and the shorter arm of the load beam 52 is moved in a direction axially toward the biasing member 27. Similarly, when the load beam 53 is moved to its second or actuated position shown in FIG. 4, the axis 64 is also rotated from its first position shown in FIG. 2 to a position shown in FIG. 4. Also, when this occurs, the longer arm of the load beam 53 is moved in a direction axially away from the biasing member assembly 27 and the shorter arm of the load beam 53 is moved in a direction axially toward the biasing member 27. Because the input force transfer member 45 is disposed radially between the housing 11 and the output member 71 and biasing members 81 and 82, this pivotal rotation of the short arms of the load beams 52 and 53 and the compression of the biasing members 81 and 82 occurs radially inside the force transfer member 45, to reduce the axial length of the actuator 10. Additionally, the pivotal movement of the longer arms of the load beams 52 and 53 is caused by the force transfer member 45 at a location adjacent the housing 11, to further provide the maximum length of the load beams 52 and 53 without increasing the axial length of the actuator 10.

The valve 20 remains in its open position until the pneumatic pressure in the chambers 33 and 35 is released and the chambers 33 and 35 are vented to atmosphere. This reduces and releases the force of the force transfer member 45 acting against the longer arms of the load beams 52 and 53, to reduce and release the force of the smaller arms of the load beams 52 and 53 acting against the output plate 71. This permits the load beams 52 and 53 to pivot about their respective pivot axes back to the first or at rest positions shown in FIGS. 2 and 3 as the valve 20 is closed. The force that initiates this movement is the above mentioned force of the biasing members 81 and 82 in their actuated positions.

Presently preferred embodiments of the invention are shown in the drawings and described in detail above. The invention is not, however, limited to these specific embodiments. Various changes and modifications can be made to this invention without departing from its teachings, and the scope of this invention is defined by the claims set out below.

What is claimed is:

1. An actuator comprising:

an input member moveable axially between a normal position and an actuated position;

a load beam having a first end and a second end, said load beam being pivotally mounted at a pivot location between said first end and said second end for pivotal movement between a normal position and an actuated position;

an output member disposed axially between said input member and said load beam, said output member being moveable axially between a normal position and an actuated position;

a biasing member having a normal position and an actuated position;

said biasing member operably engaging said output member and biasing said output member to its said normal position when said biasing member is in its said normal position;

a housing; and an output shaft;

said load beam being operably engaged by said input member substantially at said first end and said input member holding said load beam in its said actuated position when said input member is in its said actuated position said input member, said output member, said load beam, and said biasing member are all disposed within said housing;

said biasing member is disposed axially between said input member and said load beam;

said output shaft is operably connected to said output member;

said output shaft extends axially from said output member and past said load beam; and said output member is disposed axially between said load beam and said biasing member.

2. An actuator as set forth in claim 1, including a stationary member located axially between said piston head and said load beam, and said biasing member acting between said stationary member and said output member.

3. An actuator as set forth in claim 1, wherein said load beam substantially at its said second end is operably connected to said output member and holds said output member in its said actuated position when said load beam is in its said actuated position.

4. An actuator as set forth in claim 3, wherein the distance between said pivot location and said first end is greater than the distance between said pivot location and said second end.

5. An actuator as set forth claim 1, wherein:

said housing is generally cylindrical and has a first axial end region and a second axial end region;

said input member is located within said first axial end region;

said load beam is located within said second axial end region; and said load beam includes a longitudinal axis substantially perpendicular to said axis of said housing when said load beam is in said normal position.

6. An actuator as set forth in claim 5, including a fluid pressure chamber disposed within said first axial end region, said fluid pressure chamber having a normal volume and an actuated volume, said actuated volume being substantially greater than said normal volume; and said input member including a piston head having an axial cross sectional area exposed to and acted upon by the fluid pressure within said fluid pressure chamber.

7. An actuator as set forth in claim 6, wherein said actuator further includes an input force transfer member, and said input force transfer member extends axially from said piston head, past said biasing member and said output member, to said load beam when said input member is in said actuated position.

8. An actuator as set forth in claim 7, wherein said input force transfer member is disposed within said housing radially outwardly of said biasing member and radially outwardly of said output member, whereby said output member and said biasing member are nested radially within said input force transfer member in their respective positions axially between said load beam member and said input member.

9. An actuator as set forth in claim 5, wherein said biasing member includes a Belleville spring, said housing has an inside diameter, said load beam has a length, and said length of said load beam is at least about eighty percent of said inside diameter of said housing.

10. An actuator as set forth in claim 5, including another fluid pressure chamber disposed within said housing, said other fluid pressure chamber having a normal volume and an actuated volume, said actuated volume being substantially greater than said normal volume; and said input member including another piston head having an axial cross sectional area exposed to and acted upon by the fluid pressure within said other fluid pressure chamber; and said other piston head being operably connected to said first mentioned piston head for axial movement therewith.

11. An actuator as set for the in claim 1, further including:

a valve connected to said housing at an end of the housing, said valve including a valve element controlling fluid pressure communication through said valve;

and said output member being operably connected to said valve element and moving said valve element to and holding said valve element at a predetermined position when said output member is in its said normal position.

12. A fluid pressure operated actuator comprising:

an axially extending generally cylindrical housing;

an output member movable relative to said housing between a first position and a second position;

a biasing member biasing said output member to said first position;

a piston head movable relative to said housing from a first position to a second position in response to fluid pressure;

a load beam assembly transferring at least a portion of said movement of said piston head to said output member to move said output member from its said first position to its said second position; and a force transferrin member;

said load beam assembly including first load beam pivotally mounted in said housing, said first load beam having a first arm and a second arm, said first arm being substantially longer than said second arm, said first load beam having a longitudinal axis substantially perpendicular to the axis of said housing;

said force transferring member extending axially from said piston head, past said biasing member and said output member, to said first load beam when said piston head is in said second position, said force transferring member being disposed within said housing radially outwardly of said biasing member and radially outwardly of said output member, whereby said output member and said biasing member are nested radially within said force transferrin member in their respective positions axially between said first load beam and said piston head;

wherein said housing has a first axial end region and a second axial end region;

wherein said piston head is located within said first axial end region;

wherein said first load beam is located within said second axial end region;

wherein said biasing member and said output member are disposed axially between said first load beam assembly and said piston head;

wherein said load beam assembly includes a second load beam disposed in said housing second end region radially opposite said first load beam, said second load beam transferring at least a portion of said movement of said piston head to said output member to move said output member from its said first position to its said second position;

said second load beam being pivotally mounted in said housing, said second load beam having a first arm and a second arm, said first arm being substantially longer than said second arm, said arms having a longitudinal axis substantially perpendicular said axis of said housing; and said biasing member and said output member being disposed axially between said second load beam and said piston head;

and further including an output shaft, said output shaft being operably connected to said output member, and said output shaft extending axially past said second load beam and between said first load beam and said second load beam.

13. A fluid pressure operated actuator as set for the in claim 12, further including:

a valve operably connected to said housing, said valve including a valve element controlling fluid pressure communication through said valve;

and said output member being operably connected to said valve element and moving said valve element to and holding said valve element at a predetermined position when said output member is in its said normal position.

14. A fluid pressure operated actuator as set forth in claim 13, further including:

fluid pressure chamber disposed within said first axial end region, said fluid pressure chamber having a first volume and a second volume, said second volume being substantially greater than said first volume; and said piston head having an axial cross sectional area exposed to and acted upon by the fluid pressure within said fluid pressure chamber.

15. A fluid pressure operated actuator as set forth in claim 14, wherein said housing has an inside diameter, each of said load beams has a length, and said length of each of said load beams is at least about eighty percent of said inside diameter of said housing.

16. A fluid pressure operated actuator as set forth in claim 12, further including:

a pivot mounting block disposed in said second end region of said housing, each of said load beams including a pivot shaft secured within said pivot mounting block, said pivot mounting block including an axial opening between said load beams, and said output shaft being slidably received within said axial opening.

* * * * *